US009957663B2

(12) United States Patent
Croes et al.

(10) Patent No.: US 9,957,663 B2
(45) **Date of Patent: *May 1, 2018**

(54) FOIL, FLOCK OR HOT STAMPING MATERIAL TO FABRIC

(71) Applicant: GroupeSTAHL, Sterling Heights, MI (US)

(72) Inventors: Rodney Croes, Miami, FL (US); Marko Jukic, Korivnica (HR)

(73) Assignee: GROUPESTAHL, Sterling Heights, MI (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/343,441

(22) Filed: Nov. 4, 2016

(65) Prior Publication Data

US 2017/0120652 A1 May 4, 2017

Related U.S. Application Data

(60) Provisional application No. 62/250,634, filed on Nov. 4, 2015.

(51) Int. Cl.

| | |
|---|---|
| ***B41J 3/407*** | (2006.01) |
| ***D06P 5/24*** | (2006.01) |
| ***D06P 5/00*** | (2006.01) |
| ***D06P 3/60*** | (2006.01) |
| *B41M 5/025* | (2006.01) |
| *B41M 5/035* | (2006.01) |
| *D06P 1/52* | (2006.01) |

(52) U.S. Cl.

CPC ..... *D06P 5/003* (2013.01); *B41J 3/4078* (2013.01); *D06P 1/5292* (2013.01); *D06P 3/60* (2013.01); *D06P 5/00* (2013.01); *B41M 5/0256* (2013.01); *B41M 5/035* (2013.01); *D06P 1/525* (2013.01); *D06P 1/5228* (2013.01); *D06P 1/5271* (2013.01); *D06P 1/5285* (2013.01)

(58) Field of Classification Search

CPC ..... D06P 5/003; D06P 1/5292; D06P 3/60; D06P 5/00; D06P 1/5285; D06P 1/5271; D06P 1/525; D06P 1/5228; B41M 5/0256; B41M 5/035; B41J 3/4078

See application file for complete search history.

(56) References Cited

U.S. PATENT DOCUMENTS

2017/0120651 A1* 5/2017 Jukic ..... D06P 3/60

* cited by examiner

*Primary Examiner* — Yaovi M Ameh

(74) *Attorney, Agent, or Firm* — Harness, Dickey & Pierce PLC

(57) ABSTRACT

A method for transferring an image to a fabric, including providing a recording medium; coating the recording medium with a specialty coating including a silicone release agent, a silicone emulsion catalyst, and a binder; printing an image on the recording medium including the specialty coating, the image being printed using a sublimation ink; adhering a powder adhesive to the image printed on the recording medium while the image is in a wet state; transferring the recording medium including powder adhesive and image to the fabric; and hot-pressing the powder adhesive and image to the fabric to adhere the powder adhesive and image to the fabric.

16 Claims, No Drawings

FOIL, FLOCK OR HOT STAMPING MATERIAL TO FABRIC

CROSS-REFERENCE TO RELATED APPLICATIONS

This application claims the benefit of U.S. Provisional Application No. 62/250,634, filed on Nov. 4, 2015. The entire disclosure of this document is herein expressly incorporated by reference.

FIELD

The present disclosure relates to a printing process that transfers inks to fabric substrates.

DETAILED DESCRIPTION

Example embodiments will now be described more fully with reference to the accompanying drawings.

The present disclosure is directed to a method of transferring inks onto a fabric substrate. The inks may be any type of ink known to one skilled in the art. In this regard, the ink may be selected from aqueous inks, solvent-based inks, pigment inks, dye inks, sublimation inks, and the like. Exemplary sublimation inks include various inks available from Sawgrass Incorporated such as Sublijet IQ, Sublijet HD, Sublijet R, Sublijet E, and ArTainium UV+™.

The selected ink may first be deposited onto a specialty recording medium using commercially available printers such as those available from Ricoh Americas Corporation (e.g., model nos. SG3110DN/SG3110DNw or SG7100DN/SG7100DNw), Sawgrass Incorporated (e.g., Sawgrass Virtuoso model nos. SG400/SG800, or Sawgrass Wide Format model no. VJ628 (25")—8 color), Seiko Epson Corporation (Epson model nos. C84/C86, C88, C120, R1800 & R1900, 1280, 1400 & 1430, 4000, 4800 & 4880, or Epson Wide Format model nos. SC-T3270 (24"), SC-T5270 (36"), SC-T7270 (44")), Mutoh America Incorporated (model no. EXD-900 (42")), Mimaki USA Incorporated (model nos. JV33-130 (54"), JV33-160 (64"), JV5-130 (54"), JV5-160 (64"), JV5-320 (128"), DS-1600AMF (64"), DS-1800AMF (72")), and Roland DGA Corporation (model nos. FJ-540 Hi-Fi Jet (54") 6-color Dye/Pigment Printer, FP-740 Hi-Fi Express (74") Strickly Sublimation Printer, RS-540 VersaArt (54") 4-color Printer, RS-640 VersaArt (64") 4-color Printer, XJ-540 (54") SOLJET Pro III, XJ-640 (64") SOLJET Pro III, and XJ-740 (74") SOLJET Pro III). Preferably, the selected printer is an ink jet printer using piezoelectric actuation to deposit the inks on the recording medium. When printing the image onto the recording medium, the image is preferably printed as a mirror image of the image intended to be transferred to the fabric.

The recording medium may be any type of recording medium including coated paper such as printing paper, polyethylene terephthalate, polyethylene, polypropylene, and polyvinyl chloride. Preferably, a coated paper such as a clay-coated paper or a machine-glazed paper is selected as the recording medium. After selecting the appropriate recording medium and before depositing the selected ink onto the recording medium, the recording medium is coated with a specialty coating that assists in subsequently transferring the ink to the fabric substrate. Compositions for the specialty coating may be seen in the attached Tables 1, 2, and 3. It should be understood that amounts of each constituent may be adjusted to either greater or less amounts, as desired.

That is, the amounts of each constituent may be either 10 percent greater or 10 percent less than what is shown in Tables 1-3.

In particular, the specialty coating compositions may include a binder, a release agent, a humectant, a pigment, and a wetting agent. The binder in compositions 1 and 2 includes a commercially available polyvinyl alcohol (PVA) such as Mowiol PVA available from Sigma-Aldrich, a viscosity aid such as carboxymethyl cellulose commercially available as Finnifix 5 available from CP Kelco, and a silicone release agent such as Syl-Off 5602 available from Dow Corning. The binder including the PVA, viscosity aid, and silicone release agent may be pre-mixed with water and heated to about 90 degrees C. for thirty minutes before being added to the other materials of the compositions. Alternatively, the binder may be a styrene/n-butyl acrylate copolymer such as Acronal S728 available from BASF (see, e.g., composition 3). If the styrene/n-butyl acrylate copolymer is used, the binder also preferably includes a cross-linking agent such as Cartabond MZI available from Archroma Paper.

In addition to the binder, the specialty coating compositions may include a silicone release agent such as Syl-Off 7920, available from Dow Corning and a silicone catalyst emulsion such as Syl-Off 7922 Catalyst Emulsion available from Dow Corning. The silicone release agent and catalyst emulsion assist in releasing the printed ink image from the specialty recording medium during subsequent transfer of the image to the fabric substrate. As can be seen in Tables 1 to 3, a ratio of the silicone release agent to the silicone catalyst emulsion is about 4 to 1 (4:1). It should be understood, however, that ratios in the range of 3:1 to 5:1 are contemplated. Preferably, the ratio is in the range of 3.5:1 to 4.5:1.

TABLE 1

Composition 1
Demonstrates Good mattness and release

| Product | Product name | solids % | wet wt (Kg) |
|---|---|---|---|
| Release | Syl-Off 7920 | 40 | 9.9 |
| Release | Syl-Off 7922 cat | 40 | 2.3 |
| Humectant | Polypropylene glycol | 100 | 9.4 |
| Binder | Mowiol soln | 9.1 | 31.9 |
| Visocity/Binder | Finnfix soln | 9.1 | 2.2 |
| Pigment | Rice Starch Remy FG | 41 | 18.0 |
| Wetting | Surfynol CT211 | 100 | 0.05 |
| Wetting | Syl-Off 5602 | 20 | 0.9 |
| | Water | | 25.39 |
| | Total | 25.00 | 100.00 |

TABLE 2

Composition 2
Demonstrates semi gloss properties and release

| Product | Product name | solids % | wet wt (Kg) |
|---|---|---|---|
| Release | Syl-Off 7920 | 40 | 3.1 |
| Release | Syl-Off 7922 cat | 40 | 0.7 |
| Humectant | Polypropylene glycol | 100 | 8.7 |
| Binder | Mowiol soln | 9.1 | 47.9 |
| Visocity/Binder | Finnfix soln | 9.1 | 3.3 |

TABLE 2-continued

| Composition 2<br>Demonstrates semi gloss properties and release | | | |
|---|---|---|---|
| Product | Product name | solids % | wet wt (Kg) |
| Pigment | Rice Starch Remy FG | 41 | 6.0 |
| Wetting | Surfynol CT211 | 100 | 0.03 |
| Wetting | Syl-Off 5602 | 20 | 0.8 |
| | Water | | 29.61 |
| | Total | 17.50 | 100.00 |

TABLE 3

| Composition 3<br>Demonstrates Good mattness and release | | | |
|---|---|---|---|
| Product | Product name | solids % | wet wt (Kg) |
| Release | Syl-Off 7990 | 40 | 11.4 |
| Release | Syl-Off 7975 cat | 40 | 2.8 |
| Binder | Acronal S728 | 50 | 13.0 |
| Pigment | Rice Starch Remy FG | 35 | 45.3 |
| Xlinker | Cartabond MZI | 100 | 0.5 |
| Wetting | Syl-Off 5602 | 20 | 0.14 |
| | Water | | 26.9 |
| | Total | 28.50 | 100.00 |

The specialty coating composition also includes a humectant such as a polypropylene glycol humectant. Other exemplary humectants include, but are not limited to, lower alcohols such as methyl alcohol, ethyl alcohol, n-propyl alcohol, isopropyl alcohol, n-butyl alcohol, sec-butyl alcohol, and t-butyl alcohol; amides such as dimethylformamide and dimethylacetamide; ketones such as acetone; ketoalcohols such as diacetone alcohol; ethers such as tetrahydrofuran and dioxane; polyalkylene glycols such as polyethylene glycol and polypropylene glycol; 6 alkylene glycols such as ethylene glycol, propylene glycol, butylene glycol, diethylene glycol, triethylene glycol, dipropylene glycol, tripropylene glycol, thiodiglycol, and hexylene glycol; glycerin; 2-pyrrolidone; N-methyl-2-pyrrolidone; and 1,3-dimethyl-imidazolidinone. These compounds may be used alone or in combination. The humectant acts as a wetting agent in the coating compositions. Other wetting agents include alkylphenylethoxylate (Surynol CT211) and fluorofunctional silicone polymer in heptane (Syl-Off 5602). Any combination of the above-noted wetting agents may be used, without departing from the scope of the present disclosure.

The specialty coating composition may include a pigment. Exemplary pigments include sulfate of alkaline earth metals, such as barium sulfate; carbonate of alkaline earth metals, such as calcium carbonate; silicas such as finely divided silicic acid and synthetic silicate; calcium silicate; alumina; hydrated alumina; titanium oxide; zinc oxide; talc; clay; and rice starches such as Rice Starch Remy FG. Preferably, the pigment is a rice starch.

After preparing the desired specialty coating composition, the specialty coating composition is deposited onto the selected recording medium. To deposit the specialty coating composition, various methods may be used including the use of an air knife, a curtain coating method, a gravure coating method, or a rod coating method. Preferably, the coating is only applied to a single side of the recording medium that is selected to receive the ink thereon. It should be understood, however, that the present disclosure contemplates depositing the specialty coating on each surface of the recording medium. Preferably, an amount of the specialty coating applied to the recording medium is about 4 grams per square meter. Amounts above and below this value, however, are contemplated.

The specialty coating on the recording medium assists in maintaining the ink in a wet state, without allowing the ink to bleed or run after being deposited on the recording medium. Further, the specialty coating on the recording medium provides good matteness, and good release of the ink from the recording medium to the fabric.

As noted above, the specialty coating on the recording medium allows the ink to remain in a wet state after being deposited onto the recording medium. While the ink remains in a wet state, the recording medium including the wet image is transferred to a tray including a powder adhesive. The powder adhesive may be either a copolyester or a thermoplastic polyurethane. Exemplary copolyesters include Unex PES T4 and Unex PES T6 commercially available from Dakota Worldwide, Inc. An exemplary thermoplastic polyurethane is TPU Unex 4073. The granules of the powder adhesive may have a particle size less than 200 microns. Other particle sizes, however, are contemplated. A softening point of the powder adhesive is generally in the range of 85 to 130 C, and a melting point of the powder adhesive is in the range of 90 C to 125 C. Further, a melt flow index of the powder adhesive is in the range of 15 g/10 min to 25 g/10 min. Specific properties of the above-noted copolyesters and thermoplastic polyurethane may be found in Table 4.

TABLE 4

| | | Material | | |
|---|---|---|---|---|
| Property | Test Method | Type 1<br>Unex PES T4<br>Copolyester 1 | Type 2<br>Unex PES T6<br>Copolyester 2 | Type 3<br>TPU Unex 4073<br>TPU |
| Softening range | Kofler | 120-130° C. | 110-118° C. | 94-110° C. |
| Melting point | DSC | 125° C. | 113° C. | 94° C. |
| Melt flow index | ISO 1133 (160° C./2.16 kg) | 25 g/10 min | 25 g/10 min | 15 g/10 min |
| Laundry up to | Supplier | up to 95° C. | up to 60° C. | up to 60° C. |
| Chemical resistance | Supplier | good | good | good |
| Own Test 'Hand/Touch/Feel' | Own | Very Stiff | Stiff | Soft |
| Own Test 'Washing' | Cycle = 45 mins/40 C. | Good | Good | Superb |
| Stretch | Own | Good | Good | Superb |

Once the recording medium including the wet image is placed in the tray including the powder adhesive, the tray may be rocked back and forth to satisfactorily coat the wet image with the powder adhesive. Alternatively, the powder adhesive is sprinkled onto the wet image. Regardless, the powder adhesive adheres to the wet image, without adhering to portions of the recording medium that do not include the image. The powder adhesive does not adhere to portions of the recording medium that do not include the wet image because the specialty coating provided to the recording medium eliminates, or at least substantially reduces, the static energy of the recording medium. In other words, the surface tension of the recording medium is affected by the specialty coating to an extent that the powder adhesive will only adhere to the wet image.

After coating the wet image with the powder adhesive, the recording medium is then transferred to the fabric that is desired to receive the image. The recording medium is placed image-side down onto the fabric, or the fabric is placed over the image-side of the recording medium. The fabric and recording medium are then hot-pressed at a temperature in the range of 180 C to 200 C for about thirty seconds. The fabric and recording medium are then removed from the heating device (e.g., hot press or hot iron) and allowed to cool (e.g., for about 30 seconds to 1 minute). Then, the recording medium is peeled away from the fabric with the image remaining on the fabric. After hot-pressing, the adhesive powder adheres to the fabric with image being retained by the adhesive powder.

With the above process, high-quality images that may be laundered at temperatures that range between 60 and 95 C. are obtained. Further, the image is excellent touch feel characteristics, and is stretchable so that the image does not crack. Preferably, the fabric is 100 percent cotton that white or light colored. It should be understood, however, that dark colored fabrics may also be used. In addition, fabric blends (e.g., fabrics including cotton and polyester) may be used without departing from the scope of the present disclosure.

It should be understood that additional foil of flocking steps may occur after transfer of the image and adhesive powder to the fabric. In this regard, with the adhesive and image adhered to the fabric, foil or flock can be placed onto the area of the fabric where the adhesive has been transferred and then heated again. The adhesive will then absorb the foil or flock to further enhance the image, as desired.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method for transferring an image to a fabric, comprising:

providing a recording medium;

coating the recording medium with a specialty coating including a silicone release agent, a silicone emulsion catalyst, and a binder;

printing an image on the recording medium including the specialty coating, the image being printed using an ink selected from the group consisting of aqueous inks, solvent-based inks, pigment inks, dye inks;

adhering a powder adhesive to the image printed on the recording medium while the image is in a wet state;

transferring the recording medium including powder adhesive and image to the fabric;

hot-pressing the powder adhesive and image to the fabric to adhere the powder adhesive and image to the fabric; and providing a flock or foil to the adhered powder adhesive and image.

2. The method according to claim 1, wherein, in the specialty coating, a ratio of an amount of the silicone release agent to an amount of the silicon emulsion catalyst is about 4 to 1.

3. The method according to claim 1, where the specialty coating further includes a humectant, a pigment, and a wetting agent.

4. The method according to claim 1, wherein the binder including polyvinyl alcohol.

5. The method according to claim 1, wherein the binder includes a styrene/n-butyl acrylate copolymer.

6. The method according to claim 1, wherein the powder adhesive is a copolyester or a thermoplastic polyurethane.

7. The method according to claim 1, wherein the powder adhesive has a melting point in the range of 90 C. to 125 C.

8. The method according to claim 1, wherein the powder adhesive has a melt flow index in the range of 15 g/10 min to 25 g/10 min.

9. The method according to claim 1, wherein the step of hot-pressing occurs at 180 C. to 200 C.

10. The method according to claim 1, wherein the fabric is 100 percent cotton.

11. The method according to claim 1, wherein the fabric includes a blend of fabrics.

12. The method according to claim 1, wherein the image is printed using an ink jet printer.

13. The method according to claim 1, wherein the powder adhesive has a particle size of less than 200 microns.

14. The method according to claim 1, wherein the powder adhesive does not adhere to portions of the recording medium that do not include the image.

15. The method according to claim 1, further comprising removing the recording medium from the fabric.

16. The method according to claim 15, wherein the image is printed on the recording medium as a mirror image to an image that is intended to be transferred to the fabric.

* * * * *